United States Patent [19]

Doerner

[11] 4,123,103

[45] Oct. 31, 1978

[54] CHAIR CONTROL FOR A TILTABLE STENOGRAPHER'S CHAIR

[76] Inventor: Frank Doerner, 138 Aberdeen Rd., Kitchener, Ontario, Canada, N2M 2Y7

[21] Appl. No.: 784,166

[22] Filed: Apr. 4, 1977

[51] Int. Cl.[2] ..... A47C 3/00

[52] U.S. Cl. ..... 297/305

[58] Field of Search ..... 248/378, 379, 372, 381; 297/304–306

[56] References Cited

U.S. PATENT DOCUMENTS

| | | | |
|---|---|---|---|
| 1,336,510 | 4/1920 | Collier | 297/305 |
| 2,093,319 | 9/1937 | Herold | 297/304 UX |
| 2,901,027 | 8/1959 | Dickson | 297/305 |
| 3,352,526 | 11/1967 | Anderson | 297/304 X |
| 3,356,414 | 12/1967 | Doerner | 297/305 X |

*Primary Examiner*—James C. Mitchell

*Attorney, Agent, or Firm*—George H. Riches and Associates

[57] ABSTRACT

This invention discloses a novel chair control for use with a tiltable stenographer's chair. It discloses a compact and improved biasing means to control the movement of the movable frame member, this biasing means being a U-shaped bolt with two helical springs thereon, inserted from the front of the chair control about which the movable frame member pivots. This new biasing means eliminates unsightly handwheels and associated mechanisms hanging down from the control and provides an extremely compact device. Also disclosed is a wrench permanently carried by the biasing means for adjustment thereof, the wrench folding out of the way after use. A second biasing means is disclosed which depends from the plate affixed to the seat and eliminates unsightly mechanisms from the front of the control. The chair controls of all the embodiments include a movable frame member which includes a downwardly depending portion at the rear of the first bracket which is affixed to the fixed frame portion which strengthens the control thereby reducing damage to the control caused by continual use.

4 Claims, 10 Drawing Figures

FIG. 2.
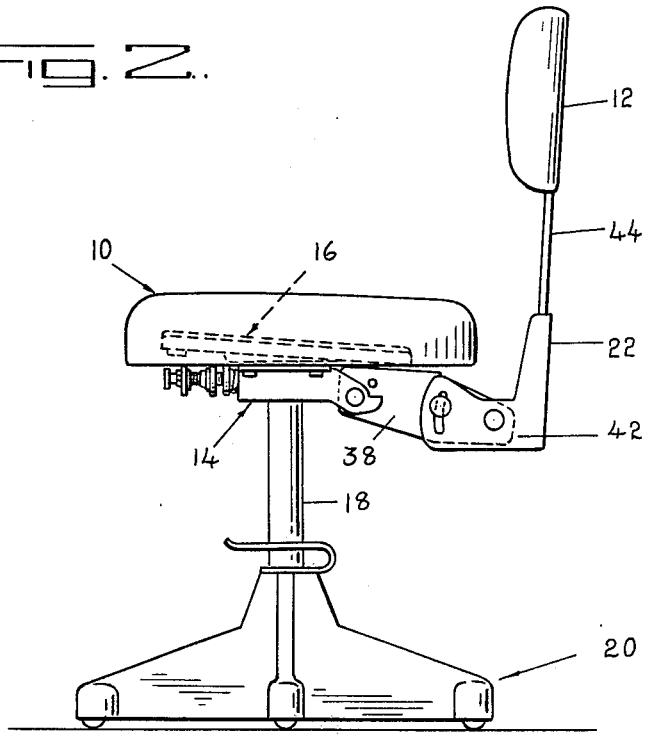
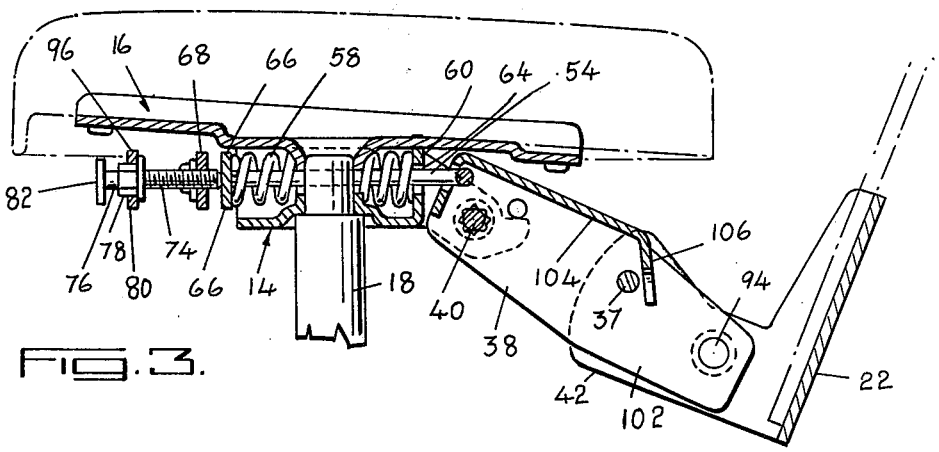
FIG. 3.

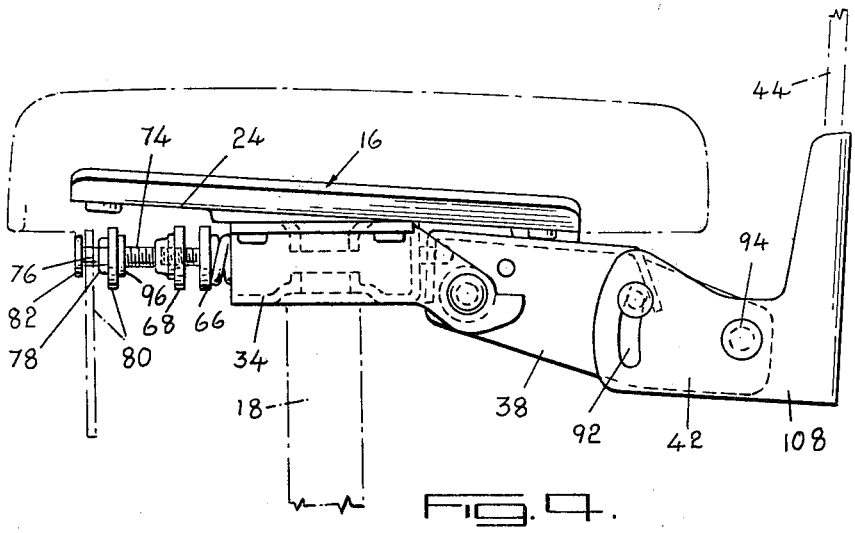
Fig. 4.
Fig. 5.
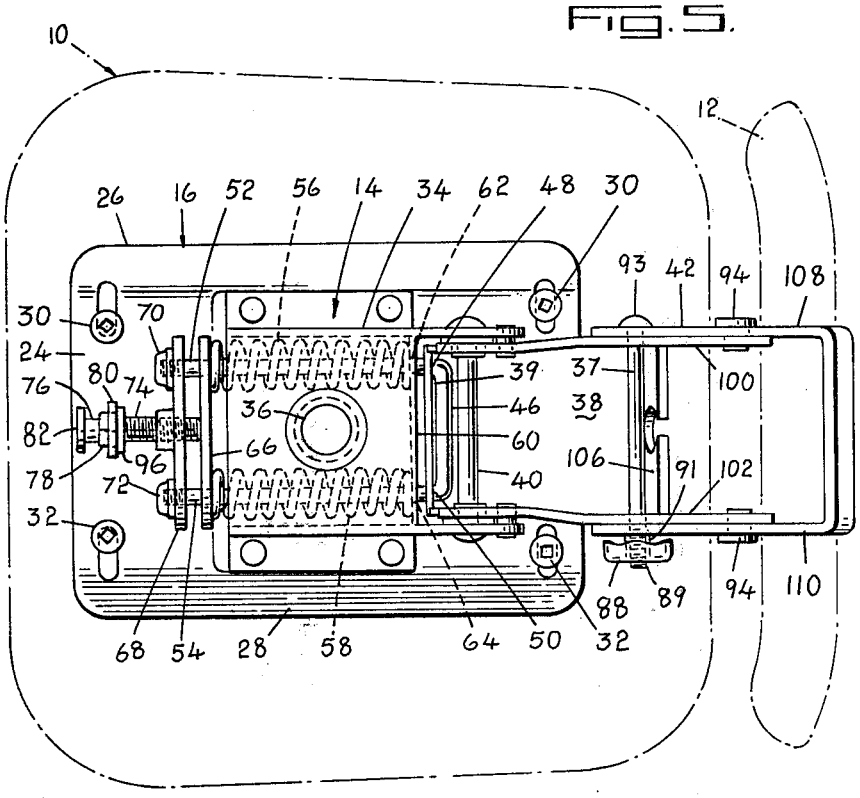

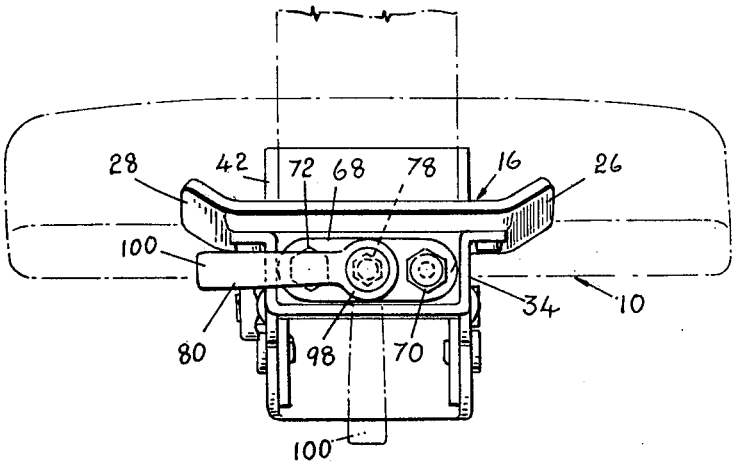
Fig. 6.
Fig. 7.
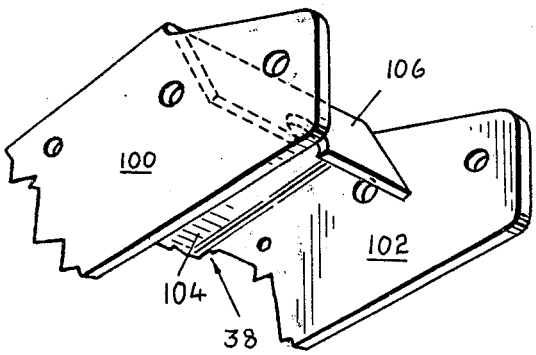

CHAIR CONTROL FOR A TILTABLE STENOGRAPHER'S CHAIR

BACKGROUND OF THE INVENTION (a) Field of the Invention

This invention relates generally to a chair and more particularly, to a chair control for the control of the tilting of tiltable chairs, particularly, stenographer's chairs.

(b) Description of the Prior Art

Stenographer's chairs comprise basically a stationary seat portion and a back portion which may or may not be tiltable. In the non-tiltable chair, the back is held securely by a one-piece bracket which is affixed to both the seat and the back portions of the chair.

In the tiltable chairs, the back portion of the chair moves rearwardly and downwardly when the user applies pressure to the back of the chair, this pressure being applied against a resisting force or biasing means which tends to return the back of the chair to the upright position when the pressure on the back of the chair is released.

The tiltable chair control of the prior art consists essentially of a fixed frame member which is mounted on a vertical post and which is attached to the undersurface of the seat of the chair and a movable frame member which is pivotally connected to the fixed frame member and adjustably connected to the back of the chair. A biasing means is provided which resists the backward and downward movement of the back of the chair from a defined normal vertical position and which returns the back of the chair to the normal resting position when the pressure is released.

The fixed frame member comprises a substantially flat plate which is secured to the undersurface of the seat and secured also to the vertical post. The movable frame member is secured to the fixed frame member behind the vertical post and pivots on a horizontal bolt. A biasing means or return control means is affixed to the rear portion of the fixed frame member passing vertically through the movable frame member and the biasing means comprises a vertical bolt and a helical spring inserted thereon. When rearward pressure is applied to the back of the chair, the movable frame portion pivots on the horizontal bolt and depresses the spring on the vertical bolt. The movable frame portion carries an upper flat plate across the front top portion thereof. The helical spring is inserted on the bolt from the bottom end and its upper end rests on the undersurface of this upper flat plate of the movable frame member. Thus, when the back of the chair is tilted backward, movement of this upper flat plate downward causes the helical spring to contract. When the pressure in the back of the chair is removed, the tension in the spring causes the spring to expand forcing the movable frame member back to the original resting position. In this position, the top surface of the upper flat plate of the movable frame member is in contact with the rear portion of the fixed frame member and therefore no further upwards movement of the movable frame member can occur.

When the pressure on the chair back is released, the tension in the compressed spring causes the back of the chair to return to the normal position. A handwheel to adjust the amount of tension in the helical spring when in the resting position is provided underneath the spring. The tension in the resting helical spring may be adjusted by the user thereby adjusting the amount of force required to tilt the back of the chair.

The movable frame member of the chair controls of the prior art comprise a first bracket pivotally connected to the fixed frame portion, a second bracket adjustably connected to the first bracket and a seat back portion which is affixed to the second bracket. The adjustable connection between the first bracket and the second bracket allows the user of the chair to adjust the position of the back of the chair in the resting position. The two brackets are usually connected (at the front of the second bracket and at the middle of the first bracket) by a horizontal bolt extending through the arms of the brackets and a tightening means comprising an adjustable handwheel. The second bracket may have an arc-shaped aperture in the forward side portions thereof so that when the tightening means is loosened, the position of the second bracket and therefore the position of the back of the chair may be adjusted with respect to the first bracket. Once the adjustment is made, the tightening means is secured. The problem is that with continual use of the chair, the tightening means becomes loosened and requires constant adjustment. Tightening this means causes the arms of the first and the second bracket to be bent inward thereby distorting its structure and causing eventual breakage.

A second problem of these controls is the shape of the vertical bolt. As the back of the chair is depressed rearward and downward, and the helical spring is contracted, the vertical bolt must pivot slightly. However, no provision has been made for this pivoting of the bolt and consequently, a wearing of the bolt and the fixed frame occurs which leads to a deterioration of the operation of the control.

A third problem of these controls is their appearance. In order to provide a pivotal connection between the fixed frame member and the movable frame member which is strong enough to sustain constant movement, a rather large mechanism was needed. Consequently, in order to provide sufficient resistance to the movement of the movable frame member and to urge it back to the normal position, a large helical spring was provided on a bolt to which a large circular handle was attached for adjusting the tension in the spring. This rather cumbersome arrangement deteriorated from the appearance of the chair.

Accordingly, it is an object of the present invention to at least partially overcome these disadvantages by providing a novel chair control for a stenographer's chair which utilizes a strong and efficient stopping means to arrest the movement of the movable frame member against the fixed frame member in an efficient manner which does not lead to the deterioration of the control.

A further object of the present invention is to provide a novel pivoting means with a provision for the pivoting of the bolt when the seat back is depressed.

A still further object of the present invention is to provide a pivotal connection between the fixed frame member and the movable frame member which is strong enough to sustain constant pressure and movement but compact enough to be attractive in appearance.

A further object of the invention is to provide a novel construction for the first bracket of the movable frame member of the chair control to provide strength to the member and prevent breakage of the control.

Another object of the present invention is to provide a novel adjustment means for adjusting the novel tension control or biasing means which does not require any other tools and may be operated easily for quick adjustments to the chair.

SUMMARY OF THE INVENTION

To this end, in one of its aspects, the invention provides a chair control for tiltable chairs comprising a fixed frame member mounted on a vertical post and affixed to the undersurface of the seat, a movable frame member pivotally affixed to the first frame member and attached to the back of the chair, the pivotal affixation being situated at a rearward point of the first frame member.

In another of its aspects, the invention further provides an improved chair control for use in a stenographer's chair, said control comprising a fixed frame member mounted on a vertical post and attached to the undersurface of the seat of said chair, a movable frame member pivotally connected to said fixed frame member and adjustably connected to the seat back, a biasing means adapted to return said back of said chair to a resting position after said back has been depressed and released, wherein said movable frame member comprises a substantially U-shaped horizontally aligned first bracket pivotally connected to said fixed frame member, a substantially U-shaped horizontally aligned second bracket, the arms of said first bracket and the arms of said second bracket overlapping and adjustably secured to each other, and a back bracket adjustably secured to said second bracket, said adjustable connection between said first and said second brackets of said movable frame member comprising a horizontal bolt extending through the arms of said first and said second brackets and a tightening means adapted to tighten and secure said first and said second brackets, said improvement comprising a downwardly depending rearward part of the top surface of the first bracket which is located between the respective arms of said first and said second brackets around said horizontal bolt, said part adapted to resist the distortion of said first and said second brackets when said tightening means is tightened.

In another of its aspects, the invention further provides a chair control for use in a tiltable stenographer's chair comprising a fixed frame member mounted on a vertical post and attached to the undersurface of the seat of said chair, a movable frame member pivotally connected to said fixed frame member and adjustably connected to the back of the seat, a biasing means connecting said fixed frame member to said movable frame member, said means adapted to return said movable frame member to a resting position, said biasing means comprising a U-shaped bolt inserted horizontally through said fixed frame member with the base of said U-shaped bolt pivotally engaged with said movable frame member, two small helical springs, one on each of the arms of said U-shaped bolt, and a tension control means on the peripheral ends of the arms of said bolt, said tension control means adapted to adjust the tension of the springs.

In a further aspect of the present invention, there is provided a wrench permanently carried on the tension control means of the biasing means adapted to be used to adjust the tension of the biasing means and when not in use, able to be stored simply and out of sight.

BRIEF DESCRIPTION OF THE DRAWINGS

Further objects and advantages of the invention will appear from the following description taken together with the accompanying drawings in which:

FIG. 2 is a side view of the chair control as shown in FIG. 1.

FIG. 3 is a sectional side view of the chair control embodying the present invention as shown in FIG. 1.

FIG. 4 is a side view of the chair control embodying the present invention as shown in FIG. 1.

FIG. 5 is an underneath plan view of the chair control embodying the present invention as shown in FIG. 1.

FIG. 6 is a front view of the chair control showing the novel tension control of the present invention.

FIG. 7 is a perspective view of the first bracket of the movable frame member of the present invention.

DESCRIPTION OF THE PREFERRED EMBODIMENTS

Figure 1:
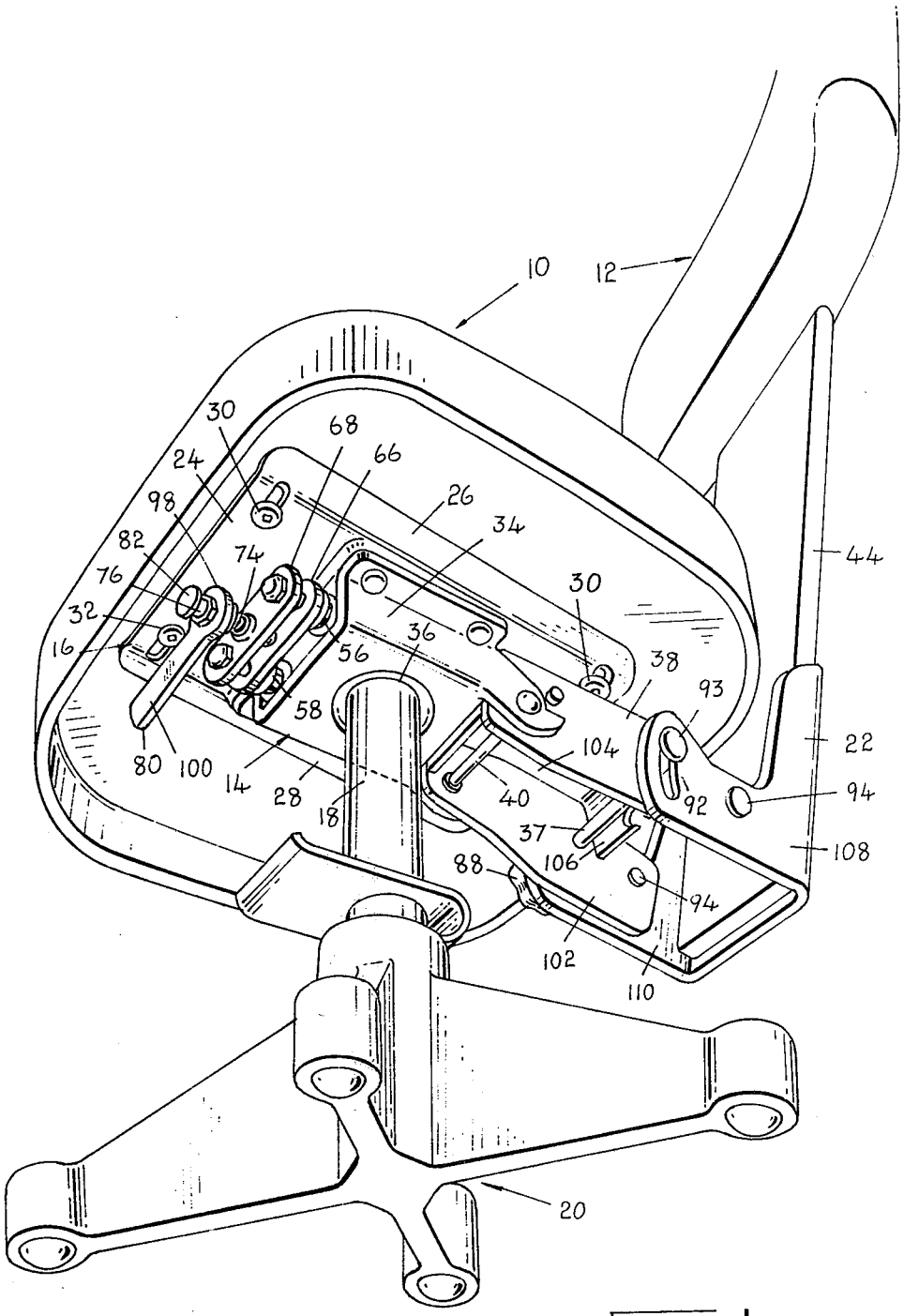
FIG. 1 is an underneath perspective view of a chair control embodying the novel biasing means of the present invention.

The present invention discloses a novel biasing means suitable for use with a tiltable stenographer's chair which improves the operation and appearance thereof. Reference is first made to FIG. 1 which shows a chair seat 10 and a chair back 12 connected by a chair control indicated generally as numeral 14. The seat 10 is affixed to a fixed frame portion 16 through which extends the spindle 18 terminating in the base 20. The fixed frame portion 16 is pivotally connected to a movable frame portion indicated generally at 22 which in turn is attached to the chair back 12.

The fixed frame portion 16 comprises a flat plate 24 with marginally upturned borders 26, 28. The fixed frame may be affixed to the seat by bolts 30, 32 or a similar fastening means. A squat, substantially U-shaped plate 34 with a central circular opening 36 through which the spindle 18 passes is affixed centrally to the undersurface of the fixed frame portion 16, the plate having an open front face and a closed rear vertical face 60 (see FIG. 5).

The movable frame portion 22 comprises a first bracket 38 which is pivotally affixed to plate 34 by a horizontal bolt 40. A second bracket 42 is adjustably affixed to the first bracket 38 by bolt 37 which allows the user of the chair to adjust the angle of the chair back 12 to suit his or her desire. The second bracket 42 is affixed to a vertical bar 44 which in turn is secured to the chair back 12. (see FIG. 2)

The novel biasing means will now be explained with reference to FIG. 5. A U-shaped bolt 46 is inserted through two corresponding holes 48, 50 in the leading wall 39 of first bracket 38 of the movable frame member and the two arms 52, 54 of the bolt 46 extend through holes 62, 64 of the U-shaped plate 34 and then through fixed frame portion 16 between the flat plate 24 and the U-shaped plate 34 around the spindle 18. The free ends of the arms of the U-shaped bolt extend marginally forward of the plate 34. Two helical springs, 56, 58 are placed, one on each arm of the bolt 46 and one terminal end rests against the inner plate 60 of the U-shaped plate 34 and the opposite ends against a substantially rectangular plate 66 placed on the free ends of the bolt. The springs are of a length marginally greater than that of the fixed frame portion 14. A second rectangular plate 68 is placed on the free ends of the U-shaped bolt 46 with locking nuts 70, 72 on the peripheral ends thereof. The second rectangular plate 68 is provided with a screw threaded central hole through which a screw threaded bolt 74 is inserted with the free end contacting the first rectangular plate 66 which is free to move inward when the screw threaded bolt 74 is tightened and to move outward when the screw bolt 74 is loosened by the expanding pressure of the helical springs 56, 58.

The novel adjustment means of the screw threaded bolt 74 will now be explained with reference to FIGS. 5 and 6. The head of the bolt 74 is provided with a first enlarged section 96, an interior polygonol section 78 and a smaller section 76. The polygonal section 78 is of larger diameter than the smaller section 76 and corresponds to the diameter of the polygonal opening of a wrench 80 so that the wrench fits snugly about the polygonal section 78 but loosely around the smaller section 76. The wrench 80 will therefore engage the inner section 78 when applied thereto but can be easily slipped forward for adjustment of its position about the smaller section 76. A larger end section 82 is provided on the extreme peripheral end of the screw threaded bolt 74 to prevent the wrench from being removed and a second larger section 96 is provided at the opposite end for the same purpose.

When the chair control of the present invention is assembled, the bolt 74 is tightened so that the first rectangular plate 66 rests inward of the leading edge of the plate 34. The user of the chair applies rearward and downward pressure to the back of the seat 12 and the bracket 38 pivots about the bolt 40 thus allowing the seat to tilt backwards and rearwards. As brackets 42 and 38 pivot about the bolt 40, the U-shaped bolt 46 is pulled rearward as well. As the helical springs 56, 58 cannot move rearward of the inner plate 60, tension is created in the chair control which tends to pull the back of the chair back to a resting position when the pressure is removed by the user thereof.

The tension of the helical spring is controlled by tightening or loosening of the bolt 74. As the bolt 74 is screwed inward, plate 66 moves inwardly correspondingly thus increasing the tension in each helical spring. This in turn requires the user of the chair to apply more rearward pressure to tilt the seat back through the same distance. Similarly, as the bolt 74 is loosened, the tension in the helical springs is reduced.

A problem associated with the chair controls of the prior art has been the adjustment of the tension controls. A handwheel is usually provided attached to the end of the biasing means which increases or decreases the tension in the biasing means by tightening or loosening the handwheel. However, it has been found that many persons using chairs having adjustable tension controls cannot easily adjust the tension in the control by turning the handwheel without mechanical assistance. Particularly, in an office, the necessary tools may not be available to make minor adjustments to the tension control and therefore, the present inventor has invented a chair control with a self-contained wrench for adjustment of the tension control, the wrench being permanently affixed to the chair control and also, being able to be stored out of sight.

Referring to FIG. 5, the head of the bolt 74 comprises a first enlarged section 96, a smaller adjacent polygonal section 78, a smaller cylindrical portion 76 and an enlarged end section 82. As shown in FIGS. 4 and 6, the wrench 80 comprises a polygonal head 98 and a handle portion 100. The polygonal head of the wrench is of sufficient size and design to snugly fit and engage the polygonal section 78 but is smaller than the section 96 and the head 82. Thus, when it is desired to adjust the tension control bolt 74, the user engages the wrench with the polygonal section 78 and turns the wrench handle. This gives the necessary leverage to adjust the position of the bolt 74 and therefore the tension in the helical springs 56 and 58 with considerably less effort than if the person attempted to turn the handwheel itself. When the adjustment is completed, the head 98 of the wrench 80 is removed from the polygonal section 78 and orientated in a position as shown in FIG. 6. The head 98 of the wrench 80 is then replaced on the polygonal section 78 to secure the wrench in this position as closely as possible. Thus, the wrench is hidden from view when not in use.

The device of the present invention provides a very compact and attractive chair control. The use of the U-shaped bolt with the helical springs reduces the depth of the chair control when compared to those of the prior art and no unsightly bolts or handwheels are seen. The improved appearance of this chair control is particularly advantageous and attractive to users of these chairs.

A second embodiment of the present invention is the novel construction of the first bracket of the movable frame portion of the chair control. This novel construction may be used as a part of chair controls which utilize the biasing means of both this invention and those of the prior art.

This embodiment will now be explained with particular reference to FIGS. 7 to 10.

The attitude of the back 12 of the chair may be adjusted by first loosening the handwheel 88 and adjusting the bolt 37 in the arc of the aperture 92 in the second bracket 42. The second bracket 42 pivots about the bolts 94 on either side thereof which extend through the second bracket 42 and the first bracket 38. Once the desired position is obtained, the handwheel 88 is tightened thereby securing the second bracket 42 to the first bracket 38 in the desired position. One end 89 of the bolt 37 is screw threaded corresponding to the interior surface of the cylindrical end 91 of the handwheel 88 so that when tightened, the handwheel 88 draws the opposite side of the first and second bracket thereto securing the connection. An enlarged head 93 is provided on the opposite end of the bolt 37 which engages the outer surface of the second bracket 42.

However, it has been found that constant pressure on the arms of the second bracket 42 and the first bracket 38 will cause a distortion and subsequent bending of the brackets from their original shape. This causes the connection to loosen thereby necessitating constant tightening of the connection and eventual breakage thereof. To eliminate this problem, a novel construction of the first bracket 38 of the movable frame portion 22 has been invented. With particular reference to FIG. 7, the first bracket 38 is designed to overcome the problem of breakage of the control by the constant tightening of the handwheel 88.

The first bracket 38 comprises two vertical sides 100, 102 with a substantially flat horizontal surface 104 therebetween. However, the rearward portion 106 of the surface 104 has been bent acutely downward. The side walls 100 and 102 therefore extend rearward of the horizontal edge of the top surface of this bracket. This construction is easily adaptable to automation and strengthens the adjustable connection between the first and second brackets of the movable frame portion of the chair control.

This particular construction of the first bracket of the movable frame portion is particularly suitable for use in chair controls which utilize the novel biasing means of the present invention and also with the biasing means of the prior art.

As seen in FIG. 1, the first bracket 38 is inserted between the second bracket 42 and the fixed frame portion and the portion 106 is inserted around bolt 37. When the user of the chair wishes to adjust the position of the back 12, handwheel 88 (see FIG. 5) is loosened and the portion of bolt 37 in the arc aperture 92 is adjustable. Once the desired position is reached, handwheel 88 is tightened thus securing the first bracket 38 and the second bracket 42 in the desired position. However, the portion 106 prevents the arms 100 and 102 (FIG. 7) from being bent towards each other by the pressure of the handwheel 88 on the bolt 37. It also prevents the arms 108, 110 (FIG. 5) of bracket 42 from being bent inwards and distorting their original shape. By eliminating this constant bending and releasing on these arms one of the problems of breakage of the control has been effectively and simply eliminated.

Figure 8:
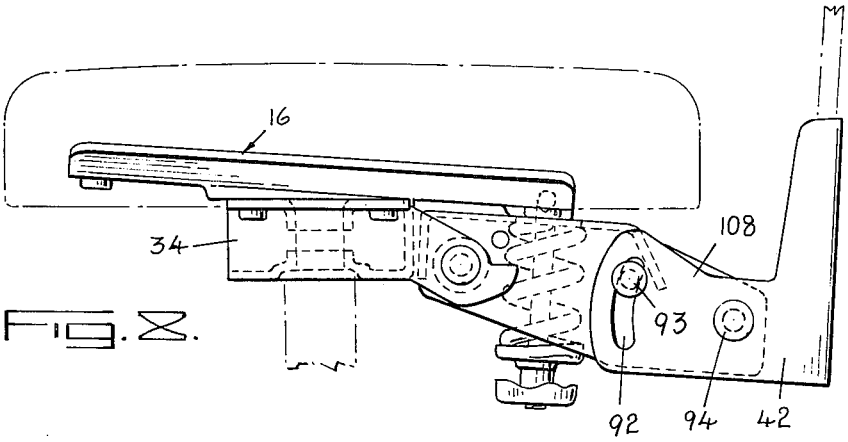
FIG. 8 is a side view of the first bracket and the movable frame portion.
Figure 9:
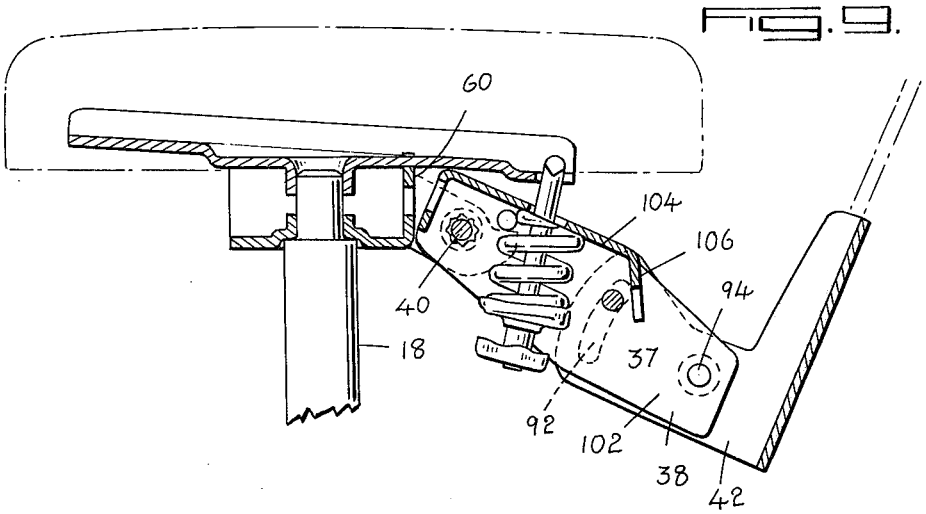
FIG. 9 is a side sectional view of the control of FIG. 8 in a tilting position.
Figure 10:
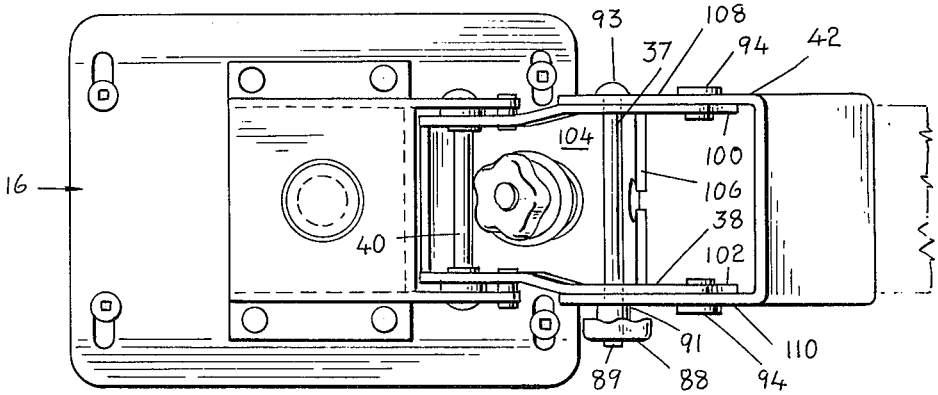
FIG. 10 is an underneath view of FIG. 9.

This novel first bracket may also be used in chair controls which utilize a vertical biasing means as shown in FIGS. 8 to 10.

Although the disclosure describes and illustrates a preferred embodiment of the invention, it is to be understood that the invention is not restricted to this particular embodiment.

What I claim is:

1. In a chair control for use with a tiltable stenographer's chair which comprises a fixed frame member mounted on a vertical post and attached to the undersurface of the seat of the chair, a movable frame member, the forward end of which is pivotally connected to said fixed frame member and with its opposite end adjustably connected to the seat back, a biasing means adapted to return said back of said chair to a resting position after said back has been depressed and released, wherein said movable frame member comprises an inverted substantially U-shaped horizontally aligned first bracket, the forward portion of which is pivotally connected to said fixed frame member, a substantially U-shaped horizontally aligned second bracket, the rearward portion of the arms of said first bracket and the forward portion of the arms of said second bracket overlapping and adjustably secured to each other, and a vertical bar, one end of which is adjustably secured to said second bracket and the other end secured to said seat back, said adjustable connection between said first and said second brackets of said movable frame member comprising a horizontal bolt extending through the arms of said first and said second brackets and a tightening means adapted to tighten and secure said first and said second brackets, the improvement comprising a downwardly depending rearward part of the top surface of said inverted substantially U-shaped first bracket which is located between the respective arms of said first and said second bracket around said horizontal bolt, said part adapted to resist the distortion of said first and said second brackets when said tightening means is tightened.

2. A chair control for use with a tiltable stenographer's chair comprising a fixed frame member mounted on a vertical post and attached to the undersurface of the seat of said chair;

a movable frame member, the forward end of which is pivotally connected to said fixed frame member and with its opposite end adjustably connected to the back of the seat;

a biasing means connecting said fixed frame member to said movable frame member, said biasing means adapted to return said back of the seat to a resting position, said biasing means comprising a U-shaped bolt inserted horizontally through said fixed frame member with the base of said U-shaped bolt pivotally engaged with said movable frame member, two small helical springs, one on each of the free arms of said U-shaped bolt, and first tightening means on the peripheral ends of the arms of said bolt, said first tightening means adapted to adjust the tension of the springs;

wherein said fixed frame member comprises a substantially flat plate secured to the undersurface of the seat of the chair and to the vertical post and a substantially U-shaped shallow bracket affixed to said flat plate through which the vertical post extends, said shallow bracket having a rearward extending flange pivotally connected to said movable frame member;

said rearward extending flange of said U-shaped shallow bracket of said fixed frame member overlapping the forward portion of said movable frame member and a horizontally aligned bolt extending through the forward portion of said movable frame member and said flange upon which the movable frame portion pivots in relation to said fixed frame member;

wherein said movable frame member comprises a first inverted substantially U-shaped bracket, the forward portion of which is pivotally connected to said flange of said fixed frame member, a substantially U-shaped second bracket, the forward portion of which is adjustably secured to the rearward portion of said first bracket, and a vertical bar, one end of which is adjustably secured to said second bracket and the other end secured to said seat back;

said second bracket having an arc-shaped aperture cut therein, and said pivotal connection between said first and said second bracket comprising a horizontal bolt extending through said first bracket and the arc-shaped aperture of said second bracket with a second tightening means exterior of one side of said second bracket, said second tightening means adapted to secure said first and said second bracket together when tightened, and the rearmost portion of each of the arms of said first bracket secured to each respective side of said second bracket.

3. The chair control as claimed in claim 2 wherein said first tightening means comprises a movable first substantially rectangular plate placed over the free ends of said U-shaped bolt, a second substantially rectangular plate secured at the peripheral ends of said U-shaped bolt and a screw threaded bolt extending through said second rectangular plate contacting the surface of said first rectangular plate, said bolt adapted to move said first plate inwards when said bolt is screwed inwards thereby decreasing the length of said helical springs and increasing the tension thereof, and wherein the peripheral portion of said screw threaded bolt of said tightening means has an enlarged head, a first polygonal nut marginally inward thereto with a second larger nut secured interior to said first nut, said screw threaded bolt carrying a wrench between the enlarged head thereof and the second nut, the head of the wrench adapted to engage the first polygonal nut.

4. The chair control as claimed in claim 3 wherein said inverted substantially U-shaped first bracket of said movable frame member has a downwardly depending rearward part of the top surface which extends between the respective arms of said first and said second bracket and around said horizontal bolt, said part adapted to resist the distortion of said first and said second brackets when said second tightening means is tightened.

* * * * *